United States Patent [19]

Müller et al.

[11] Patent Number: 4,475,785

[45] Date of Patent: Oct. 9, 1984

[54] DEVICE WITH TENSION RELIEF FOR THE RETENTION OF A FLAT BAND CABLE

[75] Inventors: Siegfried Müller, Frankfurt; Harmut Schulte, Glauburg, both of Fed. Rep. of Germany

[73] Assignee: Triumph-Adler A.G. fur Buro-und Informationstechnik, Nuremberg, Fed. Rep. of Germany

[21] Appl. No.: 463,388

[22] Filed: Feb. 3, 1983

[30] Foreign Application Priority Data

Feb. 5, 1982 [DE] Fed. Rep. of Germany ..... 3203925

[51] Int. Cl.[3] ..... H01R 13/639

[52] U.S. Cl. ..... 339/75 P; 339/103 M; 339/105; 339/176 MF

[58] Field of Search ..... 339/17 F, 75 P, 91 R, 339/103 M, 105, 125 R, 176 MF

[56] References Cited

U.S. PATENT DOCUMENTS

| | | | |
|---|---|---|---|
| 4,006,957 | 2/1977 | Narozny | 339/103 M |
| 4,111,512 | 9/1978 | Parmer et al. | 339/105 |
| 4,117,998 | 10/1978 | Notoya | 339/105 |
| 4,381,129 | 4/1983 | Krenz | 339/176 MF |
| 4,407,556 | 10/1983 | Hoschett | 339/75 P |
| 4,418,976 | 12/1983 | Lenzini et al. | 339/75 P |

FOREIGN PATENT DOCUMENTS

| | | | |
|---|---|---|---|
| 2844346 | 4/1979 | Fed. Rep. of Germany | 339/17 F |
| 2245266 | 4/1975 | France | 339/105 |

OTHER PUBLICATIONS

IBM Technical Disclosure Bulletin, vol. 21 No. 5, 10/1978 "Connector Retainer"; Cahill, M. L.

*Primary Examiner*—John McQuade
*Attorney, Agent, or Firm*—Joseph R. Spalla

[57] ABSTRACT

An easily produced and assembled one piece connector adapted to be detachably fastened to a movable carriage, for example the movable carriage of a printer. The connector is formed of various parts which can be folded relative to one another and joined together to secure plug connections between a flexible flat band cable and electrical motors or electromagnets on the carriage, and to retain and secure the flat band cable adjacent to its plug connection so as to provide tension relief.

5 Claims, 3 Drawing Figures

DEVICE WITH TENSION RELIEF FOR THE RETENTION OF A FLAT BAND CABLE

This invention relates to a connector for anchoring a flexible flat band cable to a movable element; and specifically to a connector for anchoring a flexible flat band cable characterized by a one-piece design adapted to be detachably connectable to the movable element.

Flat band cables are often needed, e.g. in typewriters, printers, etc., to establish a connection between electrical components mounted on a movable carriage, for example a carriage supporting print elements, and electronic control circuitry mounted on a frame supporting the movable carriage. The electrical components on the carriage are, for instance, the drive magnets of a wire printer, or the motor for positioning a type wheel or other type carrier. Flat band cables which follow carriage motions must be mounted so that, on the one hand, breakage of the cable cannot occur and, on the other hand, the cable and the plugs fastened thereon should be relieved of tension forces to avoid malfunctions. Malfunctions can be caused by the cable detaching from its plug or plug connections being pulled apart.

Connectors for flat band cable are known to the art. However, they are very costly because they consist of a number of individual parts which must be produced and assembled separately. This results in considerable assembly costs. Furthermore, some of the known connectors of this kind have overly large space requirements.

In accordance with the invention, a connector is provided which consists of but a single part which, on interposing the terminal end of a flexible flat band cable, can be folded and joined together so that the flat band cable as well as its plug and counterplug are tension-relieved. The foldable parts of the connector which are detachably joined together serve to clamp the flat band cable brtween them adjacent the plug connections to provide tension relief.

The connector is designed not only to hold and guide the flat band cable so as to prevent breakage, but to retain the cable plug and counterplug as well. The flat band cable is additionally held in a reverse arch by elastic webs providing additional clamping action.

It is an object of the invention to provide a flexible cable connector which is simple to produce and simple to assemble without the necessity for additional fasteners such as screws, etc.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
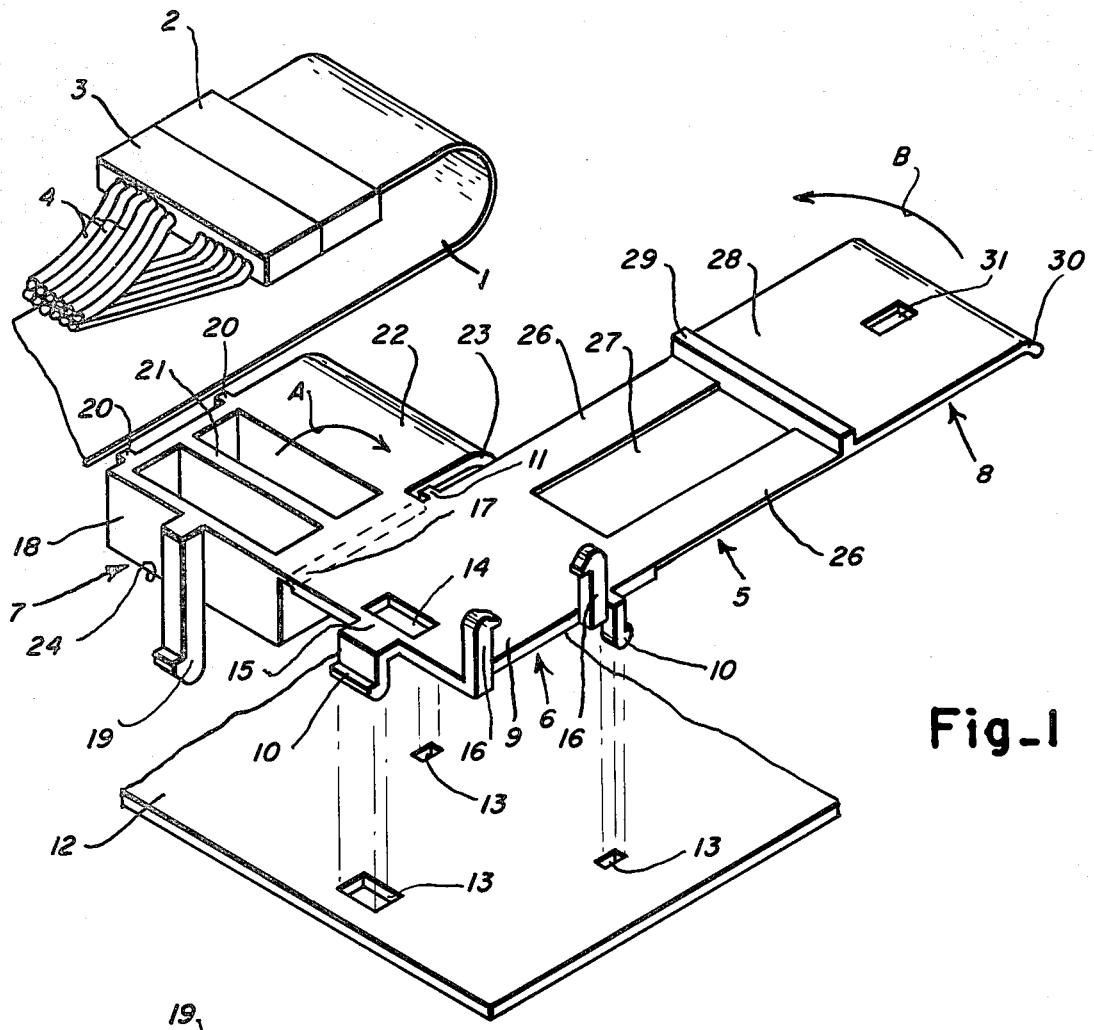
FIG. 1 is an exploded perspective view of a connector in accordance with the invention in an open condition positioned for assembly with a flexible flat band cable and to a movable carriage.

Referring now the drawing there is shown in FIG. 1 a terminal portion of a signal carrying flexible flat band cable 1 whose conductors are at one end fastened to a plug 2 adapted to be connected to a counterplug 3 to which wires from carriage mounted needle driving magnets (not shown), or from a type disc positioning motor (not shown) are connected. The other end (not shown) of the conductors of the flat band cable 1 remote from plug 2 are electrically connected to signal generating electronic control circuitry secured to a machine frame. The cable 1 must, therefore, follow carriage movement.

A flat band cable connector, generally designated by reference numeral 5, consists of individual parts generally designated by reference numerals 6, 7, and 8, the design and function of which are described infra. The entire connector 5 is produced as a single part injection molding with a certain amount of elasticity.

Part 6 of the connector 5 forms a base plate 9 to which depending fastening hooks 10 are molded. Two such fastening hooks are shown in FIG. 1. A third hook may be provided at the underside of the protrusion 11, for instance. The connector 5 is adapted to be fastened to the plate 12 of a movable carriage by insertion of the fastening hooks 10 into recesses 13 in the carriage plate 12 and for engagement with edges of the recesses 13 (FIG. 2), resulting in a detachable connection between carriage plate 12 and connector 5. The carriage plate 12 may be the base plate of a type carrier carriage, for example, it being understood that the connector 5 need not be mounted on top of the plate 12 as shown but may just as well be provided on its underside or on a carriage side-wall. It is expedient to provide in the connector base plate 9, in the vicinity of at least one fastening hook 10, a cutout 14, resulting in a spring web 15 to which one of the fastening hooks 10 is molded. This facilitates the detachment of the connector 5 from the carriage plate 12.

Two upstanding retaining hooks 16 whose function will be explained infra, are molded on the right side of the base plate 9. On the side of base plate 9 opposite the retaining hooks 16, a "film hinge" 17 forms the transition from connector part 6 to connector part 7 of the connector 5. The film hinge 17 permits part 7 to be pivoted in the direction of arrow A towards part 6.

Part 7 is formed by a housing 18 to which a depending spring hook 19 and two detaining lugs 20 on the side of housing 18 opposite the hinge 17 are xolded. The detaining lugs 20 are mutually spaced in accordance with the spacing of the retaining hooks 16 on part 6 of connector 5. The inside of housing 18 has a center web 21. The design of the housing 18 is hollow for reasons concerned with facilitating injection molding and has no functional significance.

Molded to the side of housing 18 opposite the spring hook 19 is a vane 22 whose free end has an arched edge 23 directed downwardly with reference to FIG. 1.

Also with reference to FIG. 1, the underside of housing 18 forms a flat 24 at whose rear end a cross strip 25 (FIGS. 2 and 3) is formed. When part 7 of connector 5 is pivoted onto its part 6, both the flat 24 and the strip 25 are on top as viewed in FIG. 2.

As viewed in FIG. 1 part 8 is adjacent to the rear of part 6, parallel to the vane 22 of part 7. Part 6 connects to part 8 by two spaced apart flexible webs 26, whose material thickness is thinner than that of parts 6 and 8 of the connector 5. The spaced webs 26 form a recess 27 and define a hinge. The transition of the webs 26 is into part 8 which comprises a clamping plate 28. With reference to FIG. 1, an upwardly directed cross strip 29 is disposed at the juncture of the webs 26 and the clamping plate 28 comprising part 8.

Figure 2:
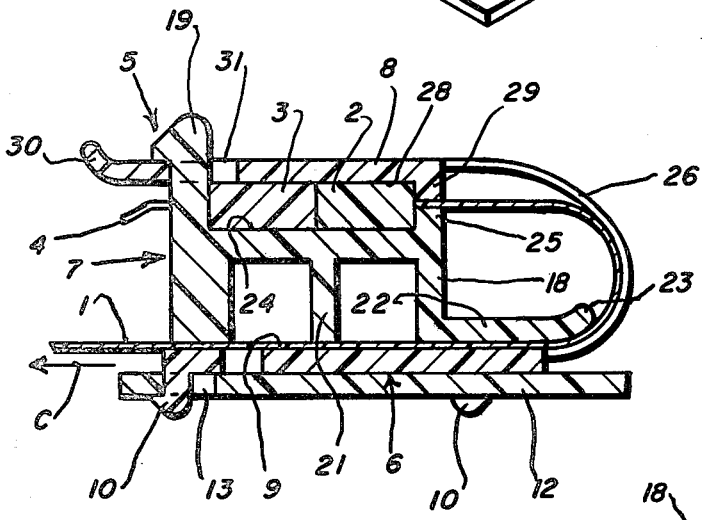
FIG. 2 is a cross sectional view of the connector after assembly with the flexible flat band cable and secured to the movable carriage.
Figure 3:
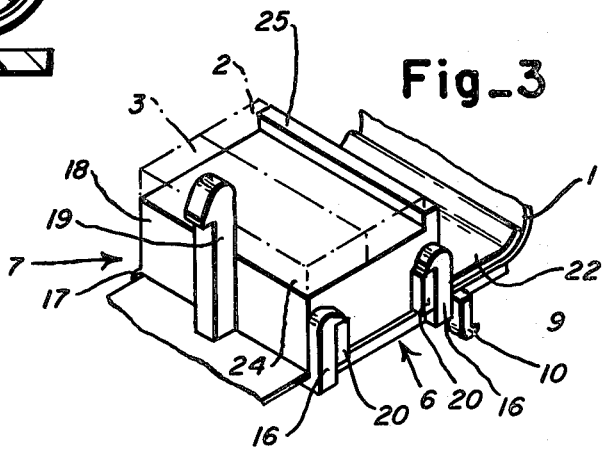
FIG. 3 is a partial perspective view of the assembly.

With further reference to FIG. 1, the free end of clamping plate 28 is bent downwardly so as to form a handling edge 30. A recess 31 is provided near the handling edge 30 in the longitudinal center plane. When the clamping plate 28 is swung in the direction of arrow B (FIG. 1), i.e. upwardly, the cross strip 29 points down and opposes strip 25 of part 7 and the handling edge 30 points up, as shown in FIG. 2.

The connector 5 comes out of the injection mold with the position of parts 6, 7, and 8 as shown in FIG. 1. This means that the flats of the parts 6, 7, and 8 lie essentially in a common, horizontal plane. The conductor 5 is assembled in the manner described in the following:

First, as already described above, part 6 can be fastened to the carriage plate 12 by means of the fastening hooks 10 in conjunction with the recesses 13. This however does not have to be the first operation as the connector 5 may be assembled first to secure the flat band cable 1 and the plugs 2 and 3, and then hooked to the plate 12.

The flat band cable 1 is placed on top of the base plate 9 of part 6 so as to extend along the parts 6 and 8, with plug 2 approximately opposite clamping plate 28 beyond cross strip 29. Part 7 of device 5, including the housing 18, is then swung in arrow direction A so that the flat 24 of housing 18 points upwardly. During the pivoting motion of part 7 about the film hinge 17, the two detaining lugs 20 arrive in the area of the retaining hooks 16. The latter are pushed apart a little by the detaining lugs 20, thus holding the two parts 6 and 7 together. The vane 22 on part 7 then rests on the flat band cable 1, pushing the latter against and clamping it to the base plate 9.

Now plug 2 can be joined to the counterplug 3. Both plugs 2 and 3 are then placed from above on top of the flat 24 of housing 18. The spring hook 19 will then protrude upwardly between the wires 4 coming out of the counterplug 3. The wires 4 may be bent apart a little for this purpose. Part 8 is then swung in direction of arrow B as enabled by flexible webs 26 with its recess 31 receiving spring hook 19 to latch part 8 to part 7. The counterplug 3 is thereby clamped, supported and retained against pull out by the spring hook 19, and plug 2 is clamped, supported, and retained against pull out by abuting cross strips 25 and 29.

The plug connection is tension relieved by the clamping action of the cable between vane 22 and base plate 9. This is aided by the webs 26 which retain the cable in a reverse arch against vane 22.

As is clear, the connector 5 can be fastened to a plate 12 in simple manner without the necessity for screws or special tools. Too no screws or special tools are required for holding the connector parts 6, 7, and 8 together. Simple plug connections 2, 3 guarantee a reliable connection and retention of the flat band cable 1. The elasticity of the material of connector 5 permits easy detachment of the parts 6, 7, and 8, or removal of the connector 5 from the carriage plate 12. The clamping plate 28 can be pivoted up by means of the handling edge 30 while simultaneously pushing the spring hook 19 opposite to the arrow direction C. After disconnecting plugs 2 and 3, the retaining hooks 16 can be pushed apart so that the retaining lugs 20 become free. This permits pivoting the part 7 back about the film hinge 17 opposite to the arrow direction A. Also, at least one of the fastening hooks 10 can be bent back far enough due to the spring web 15 so that the device 5 can be removed from the plate 12.

Production of the connector 5 is also very simple because only a single part which can be injection molded is involved.

The invention claimed is:

1. A connector for the retention of a flexible flat band cable having at one end a plug joinable to a counterplug comprising integrally formed first, second and third parts, hinge means pivotally joining said second and third parts to said first part, said flat band cable being clampable between said first and second parts when pivoted about said hinge means and detachably connected together, said plugs being clampable between said second and said third parts when they are pivoted about said hinge means and detachably connected together thereby retaining said plugs counter to their plugging direction, and means comprising complimentary hookshaped retaining means on said parts for detachably connecting said first and second parts and said second and third parts to each other when pivoted about said hinge means.

2. A connector as recited in claim 1, said second part having a vane for engaging a base plate of said first part for clamping said cable therebetween, and an arched edge at the free end of said vane for guiding said flat band cable extending from between said detachably connected first and second parts to between said detachably connected second and third parts, the height of said second part determining the radius of the reversal of said flat band cable extending from between said detachably connected first and second parts to between said detachably connected second and third parts.

3. A connector as recited in claim 1, said third part comprising a clamping plate, said hinge means between said first and third parts comprising webs connecting said clamping plate to a base plate of said first part, and said means detachably connecting second and third parts respectively comprising a spring hook and a recess, said webs defining a reverse arch for guiding of the flat band cable when said third part is pivoted about said hinge means.

4. A connector as recited in claim 1, strips disposed on said second and third parts, respectively, such that, in the pivoted position of said second and third parts, said strips are superposed to one another, with said flat band cable clamped between them.

5. A connector as recited in claim 1, a carriage plate having recesses, and fastening hooks on said first part engageable with said recesses.

* * * * *